US006949016B1

(12) United States Patent
de la Llera et al.

(10) Patent No.: US 6,949,016 B1
(45) Date of Patent: Sep. 27, 2005

(54) GIMBALLED CONDITIONING APPARATUS

(75) Inventors: Anthony de la Llera, Union City, CA (US); Xuyen Pham, Fremont, CA (US)

(73) Assignee: Lam Research Corporation, Fremont, CA (US)

( * ) Notice: Subject to any disclaimer, the term of this patent is extended or adjusted under 35 U.S.C. 154(b) by 0 days.

(21) Appl. No.: 10/112,399

(22) Filed: Mar. 29, 2002

(51) Int. Cl.[7] ..... B24B 5/00; B24B 21/18
(52) U.S. Cl. ..... 451/285; 451/443; 451/56
(58) Field of Search ..... 451/56, 443, 285–289, 451/444, 72

(56) References Cited

U.S. PATENT DOCUMENTS 5,216,843 A * 6/1993 Breivogel et al. ..... 451/285
5,941,762 A * 8/1999 Ravkin et al. ..... 451/443
6,036,583 A * 3/2000 Perlov et al. ..... 451/288
6,042,457 A * 3/2000 Wilson et al. ..... 451/443
6,106,379 A * 8/2000 Mosca ..... 451/288
6,234,868 B1 * 5/2001 Easter et al. ..... 451/288
6,361,423 B2 * 3/2002 Gurusamy et al. ..... 451/443
6,572,440 B2 * 6/2003 Moore ..... 451/285

* cited by examiner

*Primary Examiner*—Hadi Shakeri
(74) *Attorney, Agent, or Firm*—Martine Penilla & Gencarella, LLP

(57) ABSTRACT

A chemical mechanical planarization (CMP) conditioning apparatus is provided. The CMP conditioning apparatus is designed to connect to a positioning arm which is capable of applying the conditioning apparatus to a processing surface. Embodiments of the CMP conditioning apparatus include a housing configured to connect to the positioning arm, and one side of the housing having a concave gimbal surface. A puck holder that a convex gimbal surface configured to mate with the concave gimbal surface of the housing is further provided. Thee puck holder receives a conditioning puck that has an attach surface and an active surface. The concave gimbal surface and the convex gimbal surface define a projected gimbal point at about a plane defined at about the active surface of the conditioning puck.

20 Claims, 12 Drawing Sheets

GIMBALLED CONDITIONING APPARATUS

BACKGROUND OF THE INVENTION

1. Field of the Invention

The present invention relates generally to the fabrication of structures on semiconductor wafers, and more specifically to apparatus used to condition preparation surfaces in chemical mechanical planarization process equipment.

2. Description of the Related Art

In the fabrication of semiconductor devices, integrated circuits are defined on semiconductor wafers by forming a plurality of layers over one another resulting in multi-level structures. As a result of the various layers disposed over one another, a surface topography of the wafer can become irregular, and an un-corrected irregularity increases with subsequent layers. Chemical Mechanical Planarization (CMP) has developed as a fabrication process utilized to planarize the surface of a semiconductor wafer, as well as to perform additional fabrication processes including polishing, buffing, substrate cleaning, etching processes, and the like.

In general, CMP processes involve the holding and rotating of a wafer against a processing surface under a controlled pressure. Typical CMP apparatus include linear belt processing systems in which a belt having a processing surface is supported between two or more drums or rollers which move the belt through a rotary path presenting a flat processing surface against which the wafer is applied. Typically, the wafer is supported and rotated by a wafer carrier, and a polishing platen is configured on the underside of the belt traveling in its circular path. The platen provides a stable surface over which the belt travels, and the wafer is applied to the processing surface of the belt against the stable surface provided by the platen.

Additional CMP apparatus include rotary CMP processing tools having a circular pad configuration for the processing surface, an orbital CMP processing tool similar to the circular CMP processing tool, a sub-aperture CMP processing tool, and other CMP processing systems providing a plurality of apparatus and configurations that, in general, utilize friction to planarize, polish, buff, clean, or otherwise process the surface of a semiconductor wafer having integrated circuits or other structures fabricated thereon.

CMP processing can include the use of varying degrees of abrasives, chemistries, fluids, and the like to maximize effective use of friction for wafer surface preparation, and several apparatus include providing for in-situ rinsing of wafers to reduce or remove the residue of CMP processing, as well as providing for cleaning and conditioning of processing surfaces during processing to increase processing surface life, and to maintain controllable and steady state processing.

In some CMP process systems, conditioning pads are used to condition or roughen the processing surface. Typically, conditioning pads are configured in pucks and mounted in a positioning arm that applies the conditioning puck against the processing surface to roughen, or rough up, the processing surface, and dislodge slurry and processing residue. The processing surface is typically a finely porous surface which can become saturated and bogged down with slurry and CMP process residue. After conditioning with the conditioning puck, additional rinsing is then implemented in some CMP processing tools to remove the dislodged slurry and other processing residue from the processing surface.

Prior art conditioning methods include sweeping the conditioning puck across the processing surface to achieve conditioning of the entire processing surface. Conditioning pucks are applied against the processing surface with sufficient downward (e.g., into the processing surface) force to condition into the texture of the processing surface. Additionally, a lateral force is applied to the conditioning puck when it is swept across the processing surface, and additional lateral forces are applied to the conditioning puck from the motion of the processing surface. Examples of processing surface forces include linear travel in linear belt processing systems, and rotary motion of rotary CMP processing tools. The combination of forces to which conditioning pucks are subjected contribute to significant and rapid wear of conditioning pucks, and necessary down-time of CMP processing systems for conditioning puck replacement.

What is needed are methods, processes, and apparatus to maximize the effective service life, and the effective implementation of conditioning pucks. The methods, processes, and apparatus should be easy to manufacture, and easy to implement in both currently operating and future CMP processing systems.

SUMMARY OF THE INVENTION

Broadly speaking, the present invention fills these needs by providing a gimballed processing surface conditioning puck. The present invention can be implemented in numerous ways, including as a process, an apparatus, a system, a device, or a method. Several embodiments of the present invention are described below.

In one embodiment, a chemical mechanical planarization conditioning apparatus is disclosed. The chemical mechanical planarization conditioning apparatus is designed to connect to a positioning arm which is capable of applying the conditioning apparatus to a processing surface. The chemical mechanical planarization conditioning apparatus includes a housing which has a first side and a second side. The first side of the housing is configured to connect to the positioning arm. The second side of the housing has a concave gimbal surface. The chemical mechanical planarization conditioning apparatus further includes a puck holder that has a convex gimbal surface configured to mate with the concave gimbal surface of the housing. The puck holder is capable of receiving a conditioning puck that has an attach surface and an active surface. The concave gimbal surface and the convex gimbal surface define a projected gimbal point at about a plane defined at about the active surface of the conditioning puck.

In another embodiment, a conditioning puck apparatus for use in chemical mechanical planarization is disclosed. The conditioning puck apparatus includes a bearing adapter, a gimballed puck holder connected to the bearing adapter, and a conditioning puck mounted in the gimballed puck holder. A gimbal surface is defined between the bearing adapter and the gimballed puck holder. The gimbal surface defines a gimbal point projected on an active surface of the conditioning puck.

In still a further embodiment, a method of making a conditioning puck apparatus for use in chemical mechanical planarization is disclosed. The method includes forming a housing that has a first end configured to attach to a positioning arm and a second end having a concave surface. A puck holder is also formed which has a first end configured to receive a conditioning puck and a second end that has a convex surface. The method then includes joining the housing and the puck holder by mating the concave surface of the housing with the convex surface of the puck holder. The joining is configured to define a gimballed attachment. The method further includes mounting a conditioning puck that has an attach surface and an active surface in the puck holder. The attach surface is positioned in the first end of the puck holder. The gimballed attachment defines a gimbal point at about the active surface of the conditioning puck.

The advantages of the present invention are numerous. One notable benefit and advantage of the invention is the more efficient utilization of a consumable conditioning puck. In accordance with an embodiment of the present invention, the conditioning puck is gimballed to maintain an essentially flat and constant contact with the processing surface it is designed to condition, and therefore wears more evenly than prior art conditioning pucks. The more even wear of embodiments of the present invention result in longer times between having to change conditioning pucks, less frequent down time for CMP systems for conditioning puck change out, and higher manufacturing through put.

Another benefit is more effective conditioning of processing surfaces with embodiments of the present invention. In accordance with embodiments of the present invention, gimballed conditioning pucks have greater surface area in contact with and conditioning of processing surfaces resulting in more effective conditioning. The more effective conditioning of the processing surface results in more precise and controllable CMP processing.

An additional benefit is ease of implementation. Embodiments of the present invention are able to be incorporated into and utilized in installed base CMP systems to improve both performance and serviceability of existing systems.

More effective implementation of conditioning pucks results in better conditioning of processing surfaces, and more control of the CMP process. Maximizing the effective service life of conditioning pucks results in less down time for conditioning puck replacement, higher through-put, and more efficient and economical manufacture of semiconductor wafers.

Other advantages of the invention will become apparent from the following detailed description, taken in conjunction with the accompanying drawings, illustrating by way of example the principles of the invention.

BRIEF DESCRIPTION OF THE DRAWINGS

The present invention will be readily understood by the following detailed description in conjunction with the accompanying drawings, wherein like reference numerals designate like structural elements.

DETAILED DESCRIPTION OF THE PREFERRED EMBODIMENTS

An invention for a gimbal used on a processing surface conditioning puck is disclosed. In preferred embodiments, the gimballed processing surface conditioning puck includes a positioning arm capable of applying the conditioning puck to a processing surface, with the conditioning puck mounted in a conditioning apparatus configured to maintain an essentially flat and constant contact between an active surface of the conditioning puck and the processing surface. In the following description, numerous specific details are set forth in order to provide a thorough understanding of the present invention. It will be understood, however, to one skilled in the art, that the present invention may be practiced without some or all of these specific details. In other instances, well known process operations have not been described in detail in order not to unnecessarily obscure the present invention.

Figure 1A:
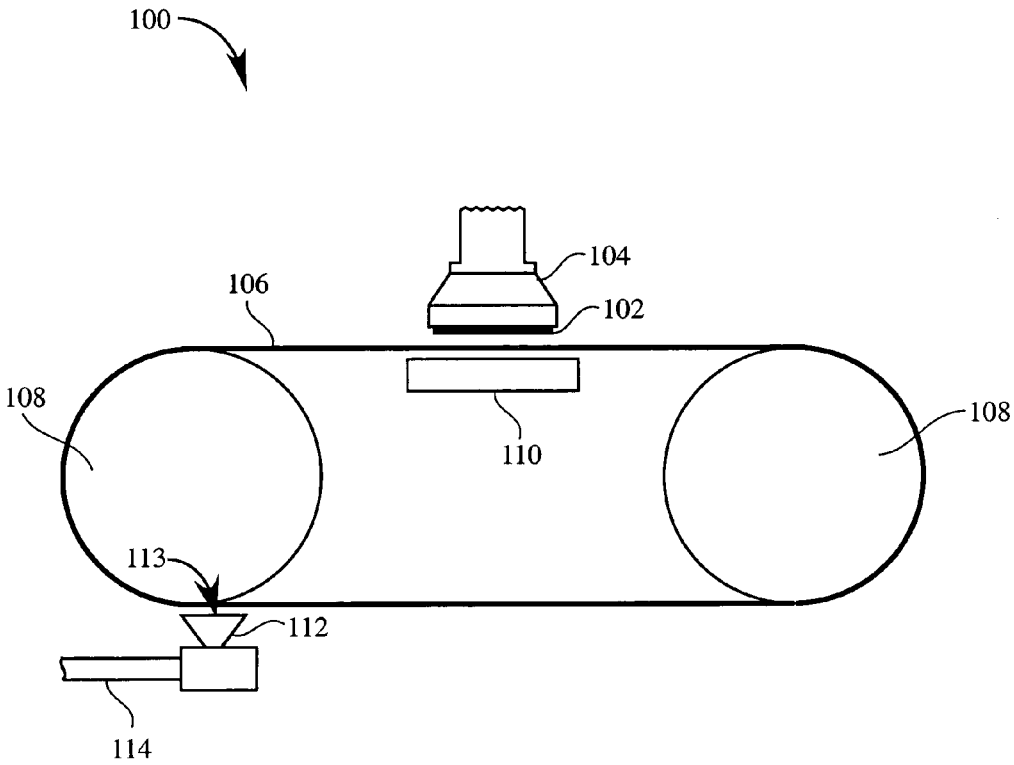
FIG. 1A shows a typical linear belt CMP processing system in accordance with one embodiment of the present invention.

FIG. 1A shows a typical linear belt CMP processing system 100 in accordance with one embodiment of the present invention. As used herein, linear belt CMP processing system 100 includes processing systems known as belt platen modules, belt roller assemblies, linear planarization tables, and any similar processing system implementing a linear belt for CMP processing of 200 mm, 300 mm, or any size wafer or substrate as is generally described herein. In the linear belt CMP processing system 100 illustrated in FIG. 1A, a wafer 102, supported by a wafer carrier 104, is applied against a linear CMP processing belt 106. The linear CMP processing belt 106 is driven by drums 108, and platen 110 is positioned beneath wafer 102 on the opposite side of the processing surface from the wafer 102 to provide support for the wafer 102 to be applied against the linear CMP processing belt 106. A conditioning puck 113 is mounted in a conditioning puck holder 112 and applied against the linear CMP processing belt 106 by conditioning puck positioning arm 114.

Figure 1B:
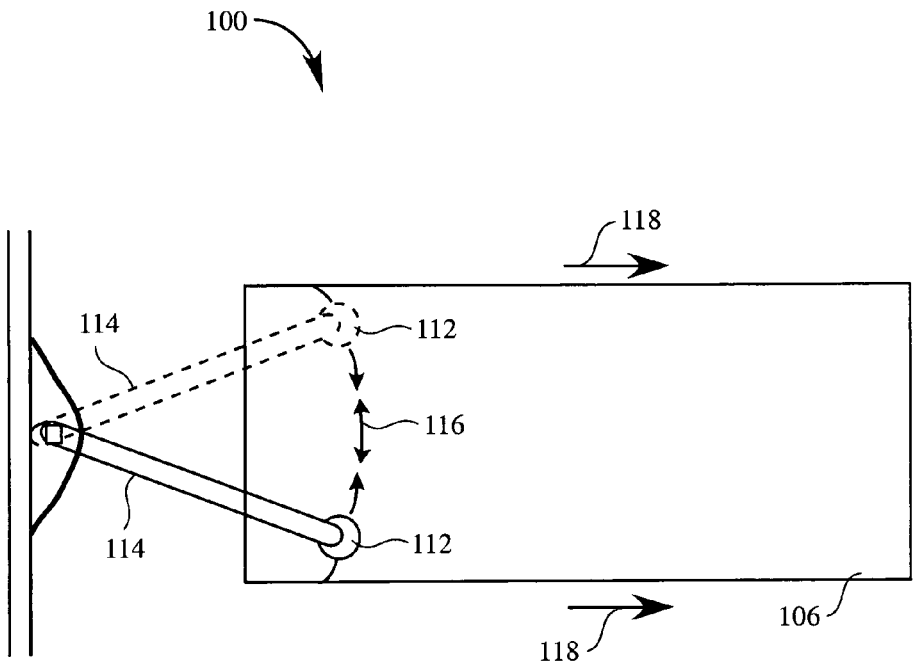
FIG. 1B shows linear CMP processing system of FIG. 1A from below the system illustrating the sweeping motion 116 of the conditioning puck (not shown) across the linear CMP processing belt 106.

FIG. 1B shows linear CMP processing system 100 of FIG. 1A from below the system illustrating the sweeping motion 116 of the conditioning puck (not shown) across the linear CMP processing belt 106. As shown in FIG. 1B, conditioning puck positioning arm 114 applies conditioning puck, mounted in conditioning puck holder 112, against the processing surface of linear CMP processing belt 106. Conditioning puck positioning arm 114 sweeps 116 conditioning puck back and forth in an arc across the processing surface of linear CMP processing belt 106 during processing to ensure conditioning of the entire processing surface. Conditioning puck positioning arm 114 and conditioning puck holder 112 are shown in solid lines and in phantom or outline to indicate positioning across the entire width of linear CMP processing belt 106. During processing, or other tool operation, linear CMP processing belt 106 travels, by way of example, in direction 118. As linear CMP processing belt 106 continues travel in direction 118 and conditioning puck is applied to the processing surface and swept 116 back and forth across the width of linear CMP processing belt 106, conditioning of essentially an entire processing surface of linear CMP processing belt 106 is accomplished.

Figure 1C:
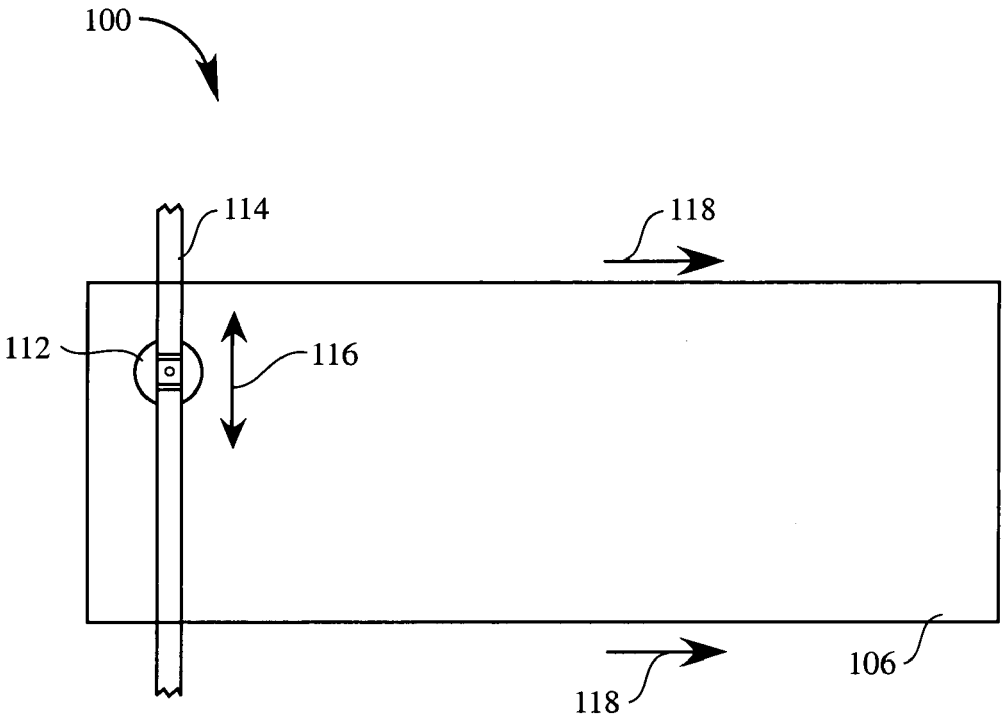
FIG. 1C shows another configuration of linear CMP processing system of FIG. 1A from below the system.

FIG. 1C shows another configuration of linear CMP processing system 100 of FIG. 1A from below the system. As shown in FIG. 1C, conditioning puck positioning arm 114 applies conditioning puck, mounted in conditioning puck holder 112, against the processing surface of linear CMP processing belt 106. Conditioning puck positioning arm 114 sweeps 116 conditioning puck back and forth across the processing surface of linear CMP processing belt 106 during processing in a linear manner. The conditioning puck traverses essentially the entire processing surface, essentially perpendicular to the direction of travel 118 of linear CMP processing belt 106 to ensure conditioning of the entire processing surface.

Figure 2A:
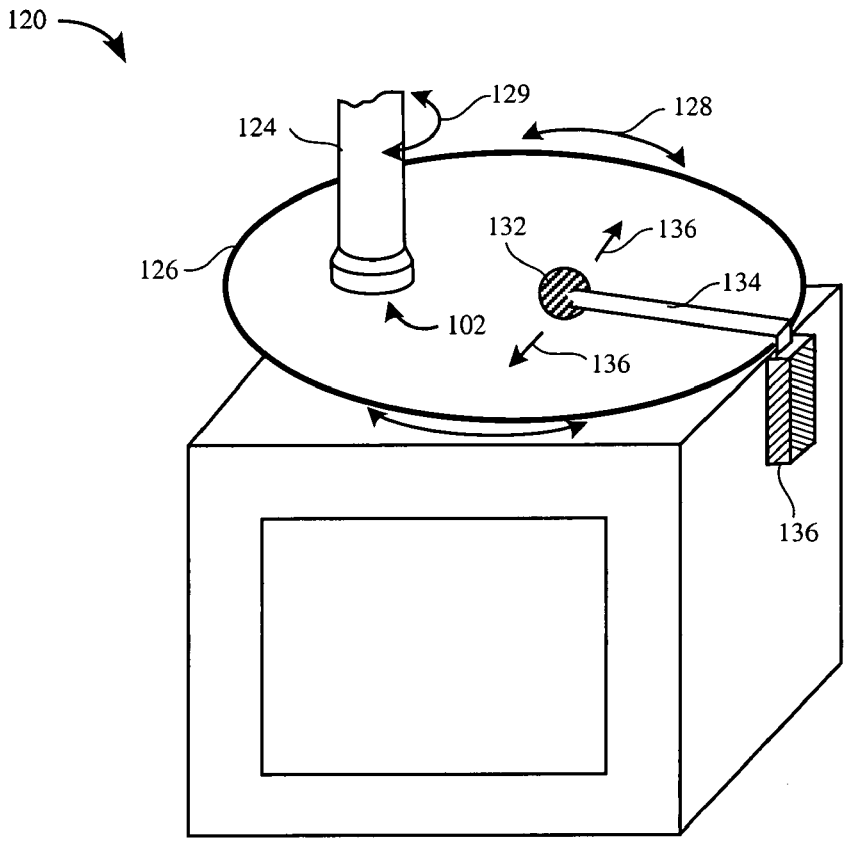
FIG. 2A shows a typical rotary CMP processing system in accordance with one embodiment of the present invention.

FIG. 2A shows a typical rotary CMP processing system 120 in accordance with one embodiment of the present invention. As used herein, rotary CMP processing system 120 includes processing systems known as rotary buff modules, rotary planarization tables, and any similar processing system implementing a rotary or generally circular processing surface for CMP processing of 200 mm, 300 mm, or any size wafer or substrate as is generally described herein. The rotary CMP processing system 120 illustrated in FIG. 2A includes a wafer carrier 124 configured to apply a wafer 102 against rotary processing pad 126, and further configured to rotate as shown at 129. Conditioning puck (not shown), mounted in conditioning puck holder 132, is applied against rotary processing pad 126 by conditioning puck positioning arm 134. Conditioning puck positioning arm 134, controlled by conditioning puck position controller 136, applies the conditioning puck against the processing surface of rotary processing pad 126 and sweeps 136 the conditioning puck back and forth across the processing surface. During processing, or other tool operation, rotary processing pad 126 is rotated, as indicated by arrow 128. Conditioning puck positioning arm 134 sweeps 136 the conditioning puck across the processing surface of rotating rotary processing pad 126 such that essentially the entire processing surface of rotary processing pad 126 is conditioned.

Figure 2B:
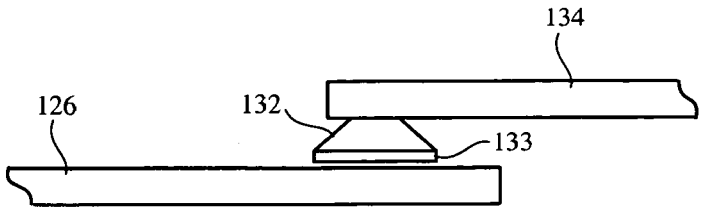
FIG. 2B shows a side view of the conditioning puck, the conditioning puck holder, and the conditioning puck positioning arm shown in FIG. 2A.

FIG. 2B shows a side view of the conditioning puck 133, the conditioning puck holder 132, and the conditioning puck positioning arm 134 shown in FIG. 2A. Conditioning puck holder 132 is configured to hold replaceable conditioning pucks 133. A conditioning puck 133 is applied against the processing surface of rotary processing pad 126 by conditioning puck positioning arm 134, which also sweeps the conditioning puck 133 back and forth across the rotary processing pad 126.

As can be appreciated from FIGS. 1A, 1B, 2A, and 2B, conditioning puck 113, 133, mounted in conditioning puck holder 112, 132, is subjected to forces applied vertically to apply the conditioning puck 113, 133, into the processing surface, and forces applied laterally from the sweeping 116, 136 of the conditioning puck across the processing surface, as well as the rotary or linear motion of the processing surface to which the conditioning puck 113, 133 is applied.

Figure 3A:
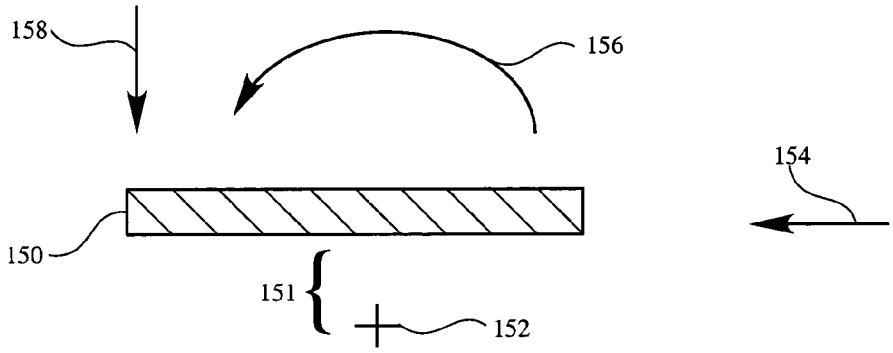
FIG. 3A shows a block diagram of a conditioning puck to which a lateral force is applied.

FIG. 3A shows a block diagram of a conditioning puck 150 to which a lateral force 154 is applied. As will be described in greater detail below in reference to FIGS. 5–8B, a conditioning puck holder can be gimballed to maintain an essentially flat and constant contact between the preparation surface, also known as the active surface, of the conditioning puck 150 and the processing surface. In a typical gimballed conditioning puck holder, the gimbal point is projected some distance away from the surface of the conditioning puck 150. The gimbal point of a typical gimballed conditioning puck holder can range from about one inch to about two inches. As used herein, a gimbal point is the center or focus of a gimballed attachment such that any resulting gimballing motion rotates about the gimbal point. In FIG. 3A, the gimbal point is represented at 152.

A lateral force 154 applied as shown in FIG. 3A to a conditioning puck 150 with a gimbal point 152 projected out some distance from the surface of the conditioning puck 150 generates a moment arm 151 between the plane of the application of lateral force 154 and the gimbal point 152. The resulting moment of force 156 is essentially a force of torque about the gimbal point 152. The moment of force 156 results in a down force component on the conditioning puck 150 at one edge, also known as "riding on the edge." When a separate down force 158 is applied to the conditioning puck 150 (e.g., when the conditioning puck positioning arm applies the conditioning puck 150 against the processing surface), the down force 158 is concentrated or focused on the edge of the conditioning puck 150 having the down force component generated by moment of force 156.

Figure 3B:
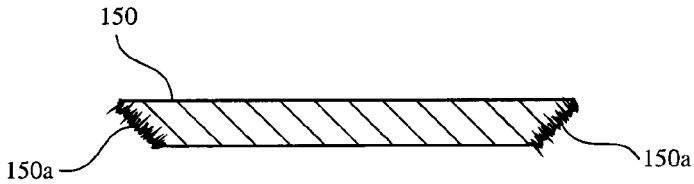
FIG. 3B is a block diagram of the conditioning puck shown in FIG. 3A showing a wear pattern of the conditioning puck with a gimbal point projected out some distance from the surface of the conditioning puck.

FIG. 3B is a block diagram of the conditioning puck 150 shown in FIG. 3A showing a wear pattern of the conditioning puck 150 with a gimbal point projected out some distance from the surface of the conditioning puck 150. Edges 150*a* exhibit the greatest amount of wear. In some CMP process tools, conditioning puck 150 is a circular structure that rotates or is rotated during use. In such a structure, the circumferential edge is worn as shown at 150*a* in FIG. 3B.

A typical conditioning puck has an attach surface which mates with the puck holder, and an active surface which is applied against the processing surface and is constructed of silicon, magnetic stainless steel, stainless steel, steel, or any other metal or other similar hard medium that may be configured to hold or support a conditioning abrasive or conditioning surface, with diamond or other similar very hard particles embedded therein as the conditioning abrasive or conditioning surface. As can be appreciated from FIG. 3B, when the primary down force is concentrated on the edge of the conditioning puck 150, the surface area of the active surface of the conditioning puck 150 in contact with the processing surface, and therefore conditioning the processing surface, is greatly reduced compared to the total surface area of the active surface of the conditioning puck. The reduced surface area in contact with and conditioning the processing surface significantly reduces the effectiveness of the conditioning, and further requires more frequent replacement of the consumable conditioning puck 150.

Figure 4A:
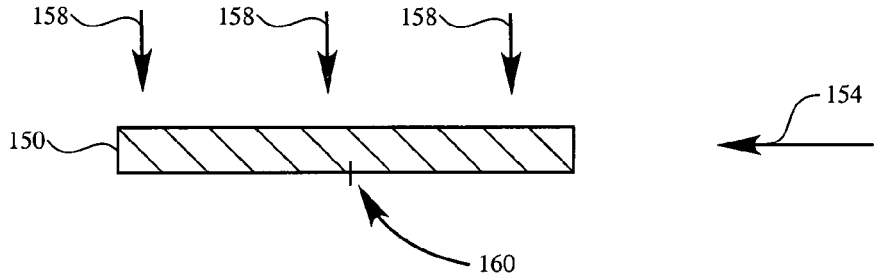
FIG. 4A shows a block diagram of another conditioning puck to which a lateral force is applied.

FIG. 4A shows a block diagram of another conditioning puck 150 to which a lateral force 154 is applied. The conditioning puck 150 illustrated in FIG. 4A has a gimbal point 160 projected on the surface of conditioning puck 150. When lateral force 154 is applied to conditioning puck 150, the force is essentially in the same plane as gimbal point 160. Therefore, no moment arm exists between the conditioning puck 150 and the gimbal point 160, and no moment of force is generated. When downward force 158 is applied, the force is distributed essentially evenly across the surface of the conditioning puck.

Figure 4B:
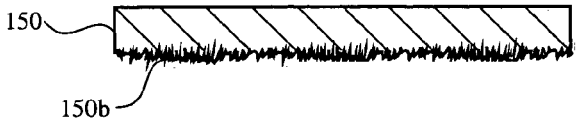
FIG. 4B is a block diagram of the conditioning puck shown in FIG. 4A showing a wear pattern of the conditioning puck with a gimbal point projected on the surface of the conditioning puck.

FIG. 4B is a block diagram of the conditioning puck 150 shown in FIG. 4A showing a wear pattern of the conditioning puck 150 with a gimbal point projected on the surface of the conditioning puck 150. Active surface 150*b* wears essentially evenly due to essentially evenly distributed force across the surface of the conditioning puck 150. The essentially even wear pattern reflects a maximum surface area of the active surface of the conditioning puck 150 in contact with a processing surface during CMP operations, maximizing the effectiveness of the conditioning, and minimizing frequency of replacement of the consumable conditioning puck 150.

FIGS. 3A–4B illustrate the moment of force generated by a gimbal point projected some distance from the surface of the conditioning puck, and the impact on the effectiveness of the conditioning of a processing surface. The exemplary figures use a down force for purposes of illustration, but it should be appreciated that the exemplary principles apply to a conditioning puck oriented to be applied against a processing surface with an up force, or any other orientation of a gimballed conditioning puck and associated application force that may be implemented.

Figure 5:
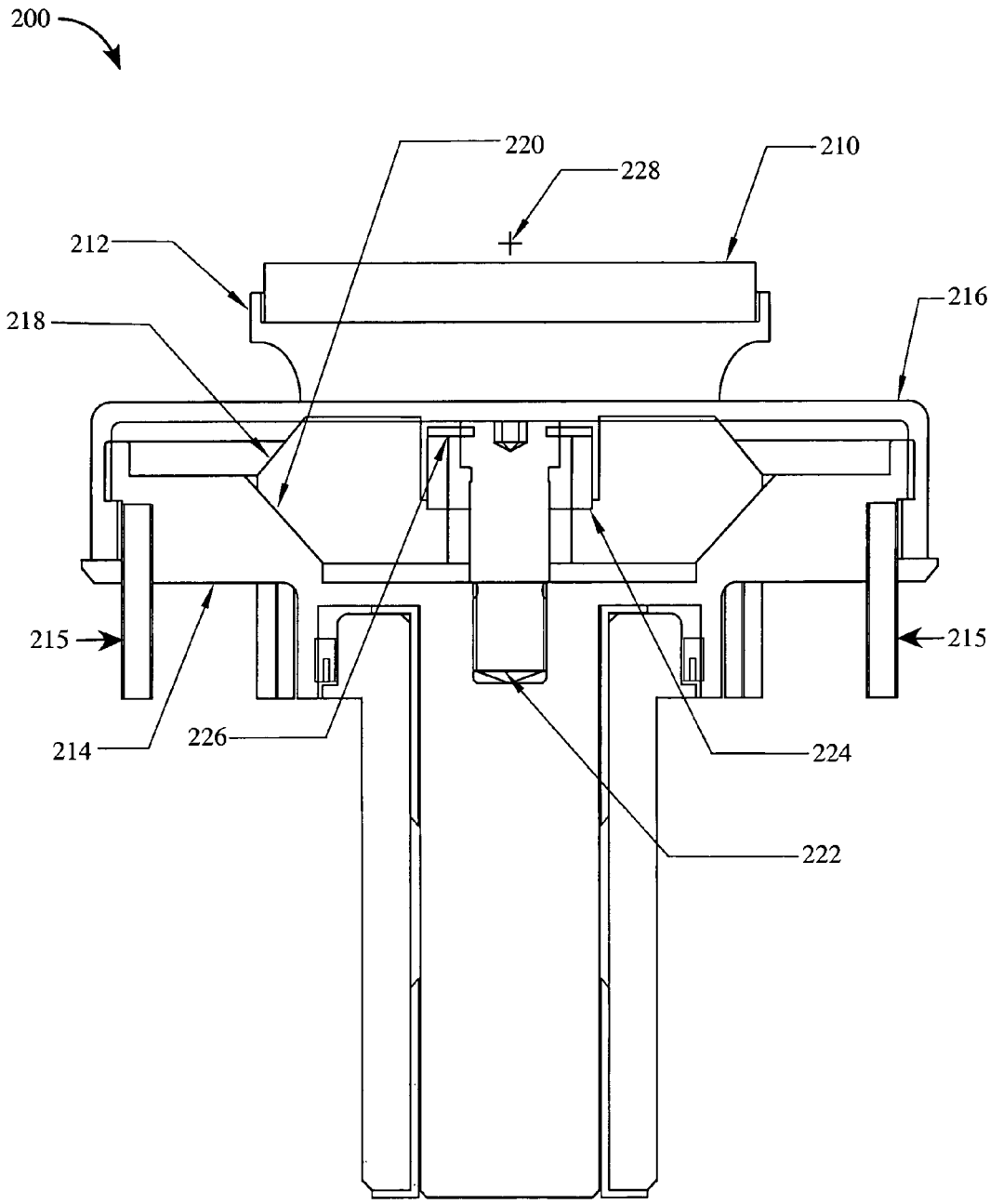
FIG. 5 shows a pad conditioner assembly as might be implemented in a linear belt CMP processing system such as the linear belt CMP processing system illustrated in FIG. 1A.

FIG. 5 shows a pad conditioner assembly 200 as might be implemented in a linear belt CMP processing system such as the linear belt CMP processing system illustrated in FIG. 1A. As used herein, a pad conditioner assembly includes conditioner assemblies used for conditioning polishing pads, linear processing belts, and all manner of processing surfaces used in CMP processing operations. The illustrated pad conditioner assembly 200 includes a conditioning puck 210 mounted in puck holder 212, which is attached to bearing 218. The pad conditioner assembly 200 is supported by an essentially fixed housing 214 which is positioned to apply the conditioning puck 210 against a processing surface (e.g., a linear CMP processing belt), and to sweep the conditioning puck 210 back and forth across the processing surface as described above in reference to FIGS. 1A and 1B.

Between housing 214 and bearing 218 is gimbal surface 220. Gimbal surface 220 provides for the surface of conditioning puck 210 to adjust to variations and inconsistencies in the processing surface, and to maintain an essentially constant and even contact between the active surface of the conditioning puck 210 and the processing surface. The geometry of the gimbal surface 220 (e.g., the angle and curvature) determines the position of the gimbal point 228. In the illustrated pad conditioner assembly 200, the gimbal point 228 is projected some distance away from the surface of conditioning puck 210. As described above in reference to FIGS. 3A and 3B, lateral forces on the conditioning puck 210 will cause a moment arm between the conditioning puck 210 and the gimbal point 228, resulting in a moment of force causing the conditioning puck to ride on the edge with insufficient conditioning of the preparation surface, and requiring frequent replacement of the conditioning puck 210.

Additional structures identified on the pad conditioner assembly 200 include a washer 226, spring 224, and shoulder screw 222 which provide for the attachment of the bearing 218 to the housing 214 allowing for gimballed movement. Ratcheting pin 215 rotates the position of the pad conditioner assembly 200 each time the pad conditioner assembly is withdrawn from a position over the processing surface and positioned in a standby or home position. In the exemplary pad conditioner assembly 200 illustrated in FIG. 5, the conditioning puck does not constantly rotate during processing, but is rotated or ratcheted a predetermined distance of rotation each time it is withdrawn from over the processing system, and the ratcheting pin 215 is contacted when the pad conditioner assembly 200 arrives in the home position. Rubber boot 216 is provided to seal water or other liquid chemistries, solutions, and the like out of the interior components of pad conditioner assembly 200.

Figure 6A:
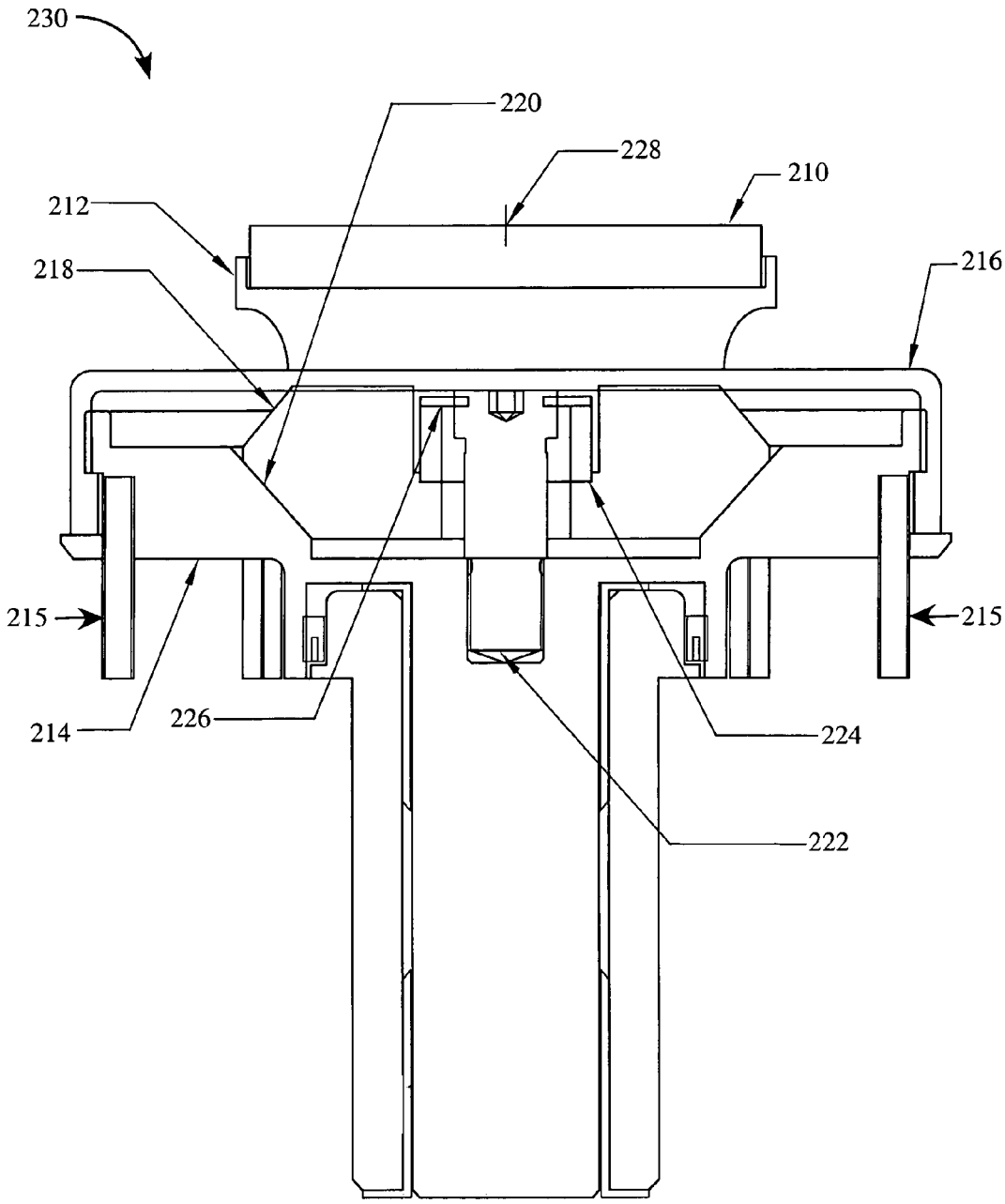
FIG. 6A illustrates pad conditioner assembly in accordance with one embodiment of the present invention.

FIG. 6A illustrates pad conditioner assembly 230 in accordance with one embodiment of the present invention. Pad conditioner assembly 230 has a similar desired function as that of pad conditioner assembly 200 illustrated in FIG. 5, and in one embodiment, is implemented in a linear belt CMP processing system such as the linear belt CMP processing system illustrated in FIG. 1A. Pad conditioner assembly 230 includes a conditioning puck 210 mounted in puck holder 212, which is attached to bearing 218. In one embodiment, the puck holder 212 is manufactured of magnetic stainless steel, and a magnetic backing of conditioning puck 210, also known as the attach surface of the conditioning puck 210, secures the conditioning puck 210 to puck holder 212. The pad conditioner assembly 230 is supported by an essentially fixed housing 214 which is positioned to apply the conditioning puck 210 against a processing surface (e.g., a linear CMP processing belt), and to sweep the conditioning puck 210 back and forth across processing surface as described above in reference to FIGS. 1A and 1B.

Between housing 214 and bearing 218 is gimbal surface 220. Gimbal surface 220, as described above in reference to FIG. 5, provides for the surface of conditioning puck 210 to adjust to variations and inconsistencies in the processing surface, and to maintain a constant and even contact between the surface of the conditioning puck 210 and the processing surface. The geometry of the gimbal surface 220 (e.g., the angle and curvature) determines the position of the gimbal point 228. In pad conditioner assembly 230, the gimbal point 228 is projected on the surface of conditioning puck 210. Lateral forces on the conditioning puck 210, therefore, will not cause a moment arm between the conditioning puck 210 and the gimbal point 228, and will not result in a moment of force. The conditioning puck 210 will maintain essentially constant and even contact with the processing surface maximizing the surface area of the conditioning puck 210 in contact with the processing surface, and thereby maximizing the degree of conditioning achieved. Additionally, replacement of the consumable conditioning puck 210 is minimized resulting in less down time, and more economical and more efficient manufacture with higher through-put.

Additional structures identified on the pad conditioner assembly 230 include a washer 226, spring 224, and shoulder screw 222 which provide for the attachment of the bearing 218 to the housing 214 at a center location of pad conditioner assembly 230 and allowing for gimballed movement. Ratcheting pin 215 rotates the position of the pad conditioner assembly 200 each time the pad conditioner assembly is withdrawn from a position over the processing surface and positioned in a standby or home position as described above in reference to FIG. 5. Rubber boot 216 is provided to seal water or other liquid chemistries, solutions, and the like out of the interior components of pad conditioner assembly 230.

Figure 6B:
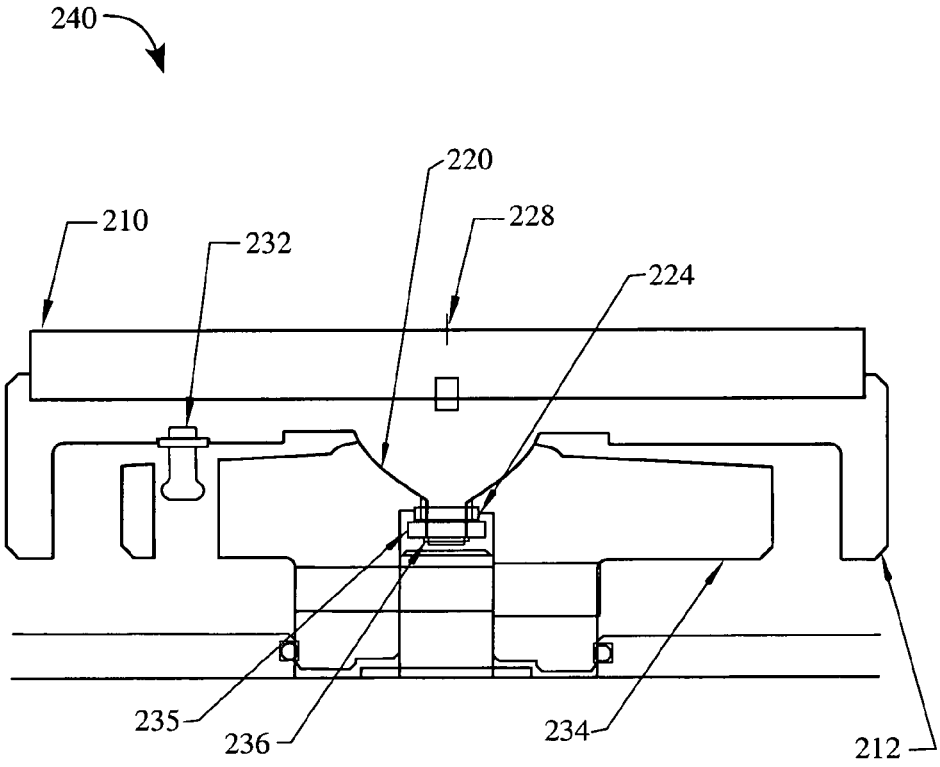
FIG. 6B shows a pad conditioner assembly in accordance with another embodiment of the present invention.

FIG. 6B shows a pad conditioner assembly 240 in accordance with another embodiment of the present invention. Pad conditioner assembly 240 is another embodiment to be implemented in a linear belt CMP processing system such as the linear belt CMP processing system illustrated in FIG. 1A. The pad conditioner assembly 240 illustrated in FIG. 6B includes a conditioning puck 210 having an attach surface and an active surface, with the attach surface mounted in puck holder 212. Bearing adapter 234 provides the essentially fixed support for the pad conditioner assembly 240, and it is the bearing adapter 234 that is positioned to apply the active surface of the conditioning puck 210 against a processing surface (e.g., a linear CMP processing belt), and to sweep the conditioning puck 210 back and forth across the processing surface as described above in reference to FIGS. 1A, 1B, and 1C. Bearing adapter 234 essentially functions as, and is also referred to as, a housing.

In the embodiment illustrated in FIG. 6B, gimbal surface 220 is defined between puck holder 212 and bearing adapter 234. In one embodiment, puck holder 212 is a single integral component manufactured of magnetic stainless steel having an essentially convex surface as a first surface and forming a peripheral lip on a second surface within which to receive the attach surface of conditioning puck 210. Bearing adapter 234 is manufactured of PET, or other similar material of sufficient strength that is light weight, smooth, and resistant to corrosion from the chemistries of CMP processing. As described above in reference to FIGS. 5 and 6A, gimbal surface 220 provides for the active surface of conditioning puck 210 to adjust to variations and inconsistencies in the processing surface, and to maintain an essentially constant and even contact between the active surface of the conditioning puck 210 and the processing surface. In one embodiment, the bearing adapter 234 (or housing) includes an essentially concave surface which is configured to mate with the puck holder 212 having an essentially convex surface, defining the gimbal surface 220. The geometry of the gimbal surface 220 (e.g., the angle and curvature) determines the position of the gimbal point 228. In the illustrated embodiment, the gimbal point 228 is projected at the surface of conditioning puck 210. As described above in reference to FIGS. 3A and 3B, gimbal point 228 at the surface of conditioning puck 210 will cause no moment arm between the conditioning puck 210 and the gimbal point 228 since the lateral force is applied in essentially the same plane as the gimbal point 228, and therefore no moment of force is generated in the illustrated embodiment.

The pad conditioner assembly 240 illustrated in FIG. 6B is configured to be constantly rotated during processing, thereby imparting additional lateral force on conditioning puck 210, such additional lateral force not imparted in the embodiments illustrated and described above in reference to FIGS. 5 and 6A. Torque pin 232 is included to allow that when the essentially fixed bearing adapter 234 is rotated, the rotational force is translated to the puck holder 212. In one embodiment, without a torque pin 232, the gimbal surface 220 would allow the bearing adapter to freely spin without any rotational force being applied to the puck holder 212, and there would therefore be no rotation of the conditioning puck on the processing surface during conditioning. In one embodiment, additional mounting or torque pins are provided in puck holder 212 to secure the translation of rotational force to conditioning puck 210.

Additional structures identified on the pad conditioner assembly 240 include a snap ring 236, spacer 235, and spring 224 provided for the attachment of the puck holder 212 to the bearing adapter 234 at a center location of pad conditioner assembly 240 and allowing for gimballed movement of the separate, but attached components of the pad conditioner 240. In the pad conditioner assembly 240 illustrated in FIG. 6B, the snap ring 236 attaches to a shaft of the puck holder 212, securing the spacer 235 and spring 224 between the snap ring 236 and the bearing adapter 234.

Figure 6C:
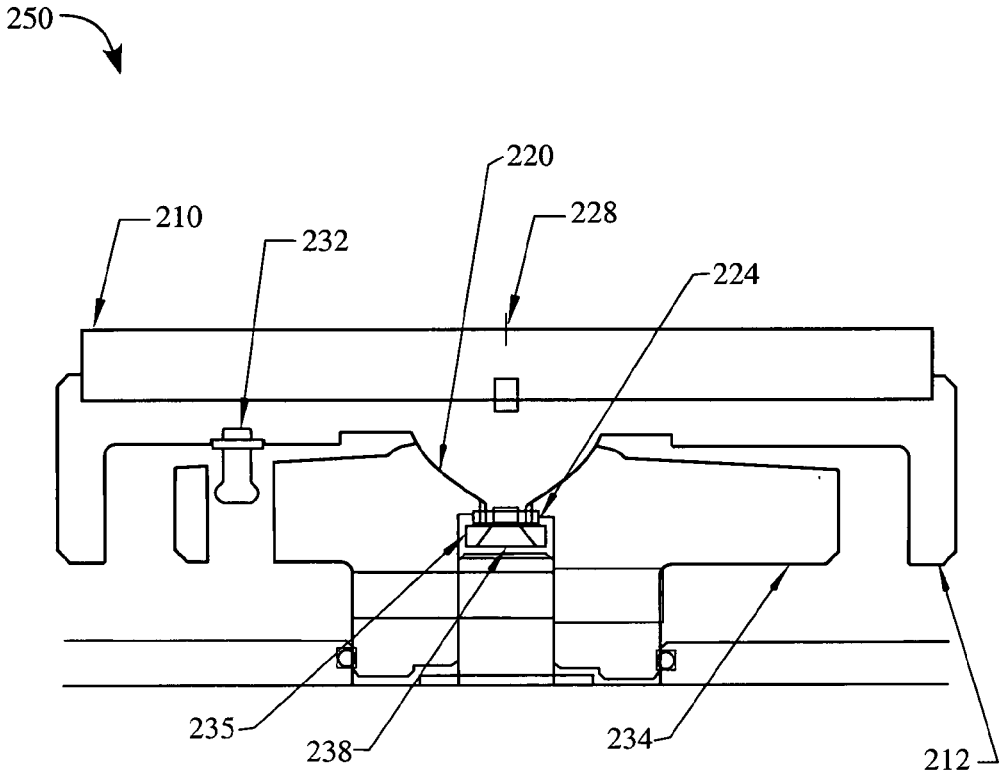
FIG. 6C shows a pad conditioner assembly in accordance with another embodiment of the present invention.

FIG. 6C shows a pad conditioner assembly 250 in accordance with another embodiment of the present invention. Pad conditioner assembly 250 is another embodiment to be implemented in a linear belt CMP processing system such as the linear belt CMP processing system illustrated in FIG. 1A. The pad conditioner assembly 250 illustrated in FIG. 6C is essentially similar to the pad conditioner assembly 240 illustrated in FIG. 6B and includes a conditioning puck 210 mounted in single integral component puck holder 212 having an essentially convex surface as a first surface and forming a lip around the periphery of a second surface within which to receive the attach surface of conditioning puck 210. Bearing adapter 234 provides the essentially fixed support for the pad conditioner assembly 240, and is also known as a housing. Bearing adapter 234 is positioned to apply the active surface of the conditioning puck 210 against a processing surface (e.g., a linear CMP processing belt), and to sweep the conditioning puck 210 back and forth across processing surface as described above in reference to FIGS. 1A, 1B, and 1C.

Gimbal surface 220 is defined between puck holder 212 and bearing adapter 234. As described above in reference to FIGS. 5, 6A, and 6B, gimbal surface 220 provides for the active surface of conditioning puck 210 to adjust to variations and inconsistencies in the processing surface, and to maintain an essentially constant and even contact between the active surface of the conditioning puck 210 and the processing surface. In one embodiment, the bearing adapter 234 (or housing) includes an essentially concave surface which is configured to mate with the puck holder 212 having an essentially convex surface, defining the gimbal surface 220. The geometry of the gimbal surface 220 (e.g., the angle and curvature) determines the position of the gimbal point 228. In the illustrated embodiment, the gimbal point 228 is projected at the surface of conditioning puck 210. As described above in reference to FIGS. 3A and 3B, gimbal point 228 at the surface of conditioning puck 210 will cause no moment arm between the conditioning puck 210 and the gimbal point 228 since the lateral force is applied in essentially the same plane as the gimbal point 228, and therefore no moment of force is generated in the illustrated embodiment.

Similar to the pad conditioner assembly 240 illustrated and described above in reference to FIG. 6B, the pad conditioner assembly 250 illustrated in FIG. 6C is configured to be constantly rotated during processing, thereby imparting additional lateral force on conditioning puck 210, such additional lateral force not imparted in the embodiments illustrated and described above in reference to FIGS. 5 and 6A. Torque pin 232 is provided as described above in reference to FIG. 6B.

Additional structures identified on the pad conditioner assembly 250 include a fastener 238, spacer 235, and spring 224 provided for the attachment of the puck holder 212 to the bearing adapter 234 at a center location of pad conditioner assembly 250 and allowing for gimballed movement of the separate, but attached components of the pad conditioner assembly 250. In the pad conditioner assembly 250 illustrated in FIG. 6C, the fastener 238, spacer 235, and spring 224, provide essentially the same function as the snap ring 236, spacer 235, and spring 224 illustrated and described above in reference to FIG. 6B. The use of a fastener 238 in the embodiment illustrated in FIG. 6C requires some hardware-specific fabrication of component parts of the pad conditioner assembly 250, and allows for faster and more manageable assembly and disassembly of the pad conditioner assembly 250 as necessary in installed CMP processing systems.

Figure 7:
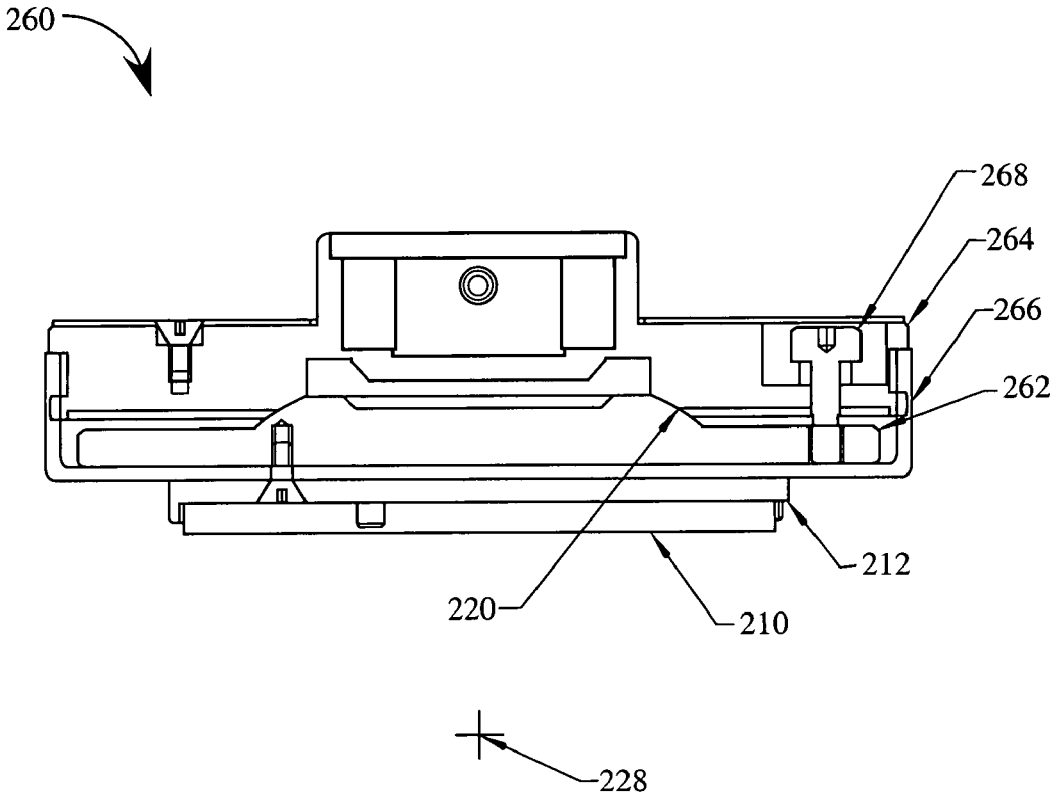
FIG. 7 shows a pad conditioner assembly as might be implemented in a rotary CMP processing system such as the rotary CMP processing system illustrated in FIG. 2A.

FIG. 7 shows a pad conditioner assembly 260 as might be implemented in a rotary CMP processing system such as the rotary CMP processing system illustrated in FIG. 2A. The illustrated pad conditioner assembly 260 includes a conditioning puck 210 mounted in puck holder 212, which is attached to bearing 262. The pad conditioner assembly 260 includes an essentially fixed housing 264 which is configured to rotate during processing surface conditioning, and is positioned to apply the active surface of the conditioning puck 210 against a processing surface (e.g., rotary CMP processing pad), and to sweep the conditioning puck 210 back and forth across the processing surface as described above in reference to FIGS. 2A and 2B.

Between housing 264 and bearing 262 is gimbal surface 220. Gimbal surface 220 provides for the active surface of conditioning puck 210 to adjust to variations and inconsistencies in the processing surface, and to maintain an essentially constant and even contact between the active surface of the conditioning puck 210 and the processing surface. The geometry of the gimbal surface 220 (e.g., the angle and curvature) determines the position of the gimbal point 228. In the illustrated pad conditioner assembly 260, the gimbal point 228 is projected some distance away from the active surface of conditioning puck 210. As described above in reference to FIGS. 3A and 3B, lateral forces on the conditioning puck 210 will cause a moment arm between the conditioning puck 210 and the gimbal point 228, resulting in a moment of force and causing the conditioning puck to ride on the edge with insufficient conditioning of the processing surface, and requiring frequent replacement of the conditioning puck 210.

Additional structures identified on the pad conditioner assembly 260 include a shoulder screw 268 to provide for the attachment of the housing 264 to the bearing 262 allowing for gimballed movement, and a rubber boot 266 to seal water or other liquid chemistries, solutions, and the like out of the interior components of pad conditioner assembly 260.

Figure 8A:
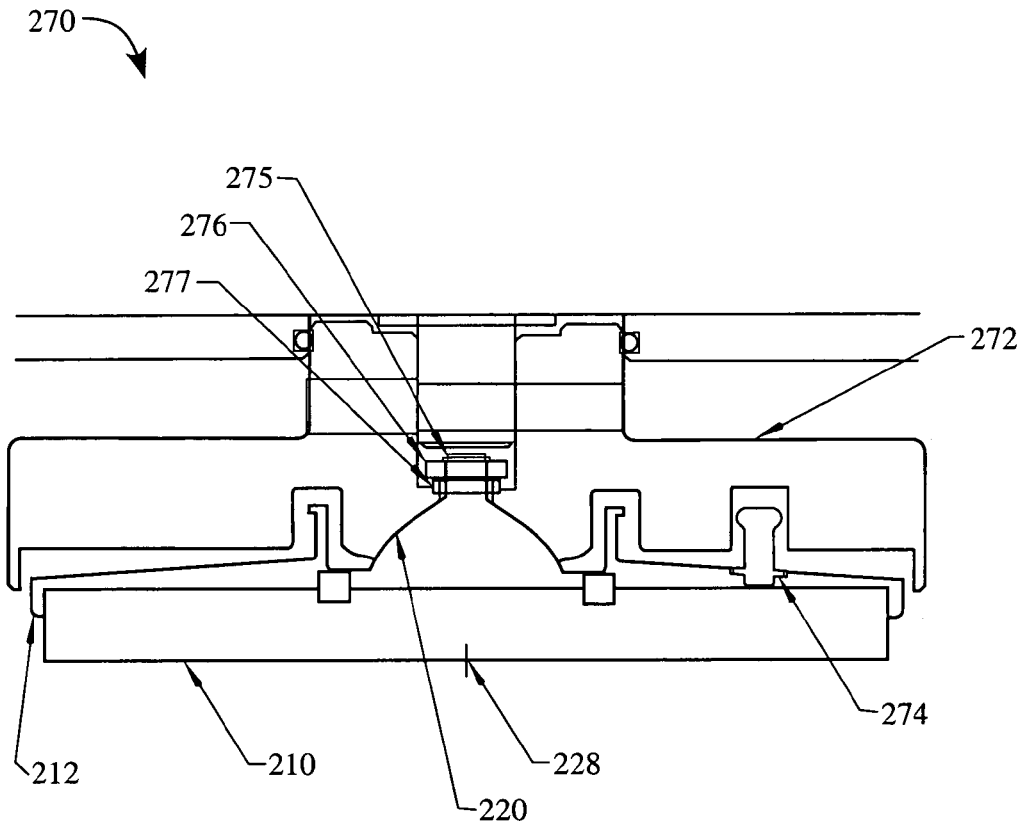
FIG. 8A illustrates pad conditioner assembly in accordance with one embodiment of the present invention.

FIG. 8A illustrates pad conditioner assembly 270 in accordance with one embodiment of the present invention. Like the pad conditioner assembly 260 illustrated in FIG. 7, one embodiment of pad conditioner assembly 270 is implemented in a rotary CMP processing system such as the rotary CMP processing system illustrated in FIG. 2A. Pad conditioner assembly 270 includes a conditioning puck 210 having an active surface and an attach surface. The attach surface is mounted in puck holder 212. The pad conditioner assembly 270 includes an essentially fixed bearing adapter 272 which is also known as a housing and is configured to rotate during processing surface conditioning. The bearing adapter 272 is positioned by the CMP processing system to apply the active surface of the conditioning puck 210 against a processing surface (e.g., rotary CMP processing pad), and to sweep the conditioning puck 210 back and forth across the processing surface as described above in reference to FIGS. 2A and 2B.

A gimbal surface 220 is defined between the single integral component that is puck holder 212 and essentially fixed bearing adapter 272. As shown in FIG. 8A, puck holder 212 is an essentially single integral component having a first surface that defines a convex surface to mate with the concave surface of bearing adapter 272 to define gimbal surface 220, and a second surface defining a peripheral lip within which is received attach surface of conditioning puck 210. As described above in reference to FIG. 7, gimbal surface 220 provides for the active surface of conditioning puck 210 to adjust to variations and inconsistencies in the processing surface, and to maintain an essentially constant and even contact between the active surface of the conditioning puck 210 and the processing surface. In one embodiment, the bearing adapter 272 (or housing) includes a concave surface which is configured to directly mate with the puck holder 212 having a convex surface, defining the gimbal surface 220. The geometry of the gimbal surface 220 (e.g., the angle and curvature) determines the position of the gimbal point 228. In the illustrated pad conditioner assembly 270, the gimbal point 228 is projected at the surface of conditioning puck 210. Because the gimbal point 228 is in essentially the same plane as lateral forces applied to conditioning puck 210, no moment arm is created between the conditioning puck 210 and the gimbal point 228, and no moment of force is created. The active surface of conditioning puck 210 therefore maintains an essentially constant and even contact with the processing surface upon which it is used for conditioning, resulting in more effective and efficient processing surface conditioning, and less frequent replacement of consumable conditioning puck 210.

Additional structures identified on the pad conditioner assembly 270 include a snap ring 275, spacer 276 and spring 277 for the attachment of the puck holder 212 to the bearing adapter 272 at a center location of pad conditioner assembly 270 and allowing for gimballed movement, and a torque pin 274 to translate rotational force from the bearing adapter 272 to the puck holder 212 to provide for conditioning puck 210 rotation during conditioning of a processing surface.

Figure 8B:
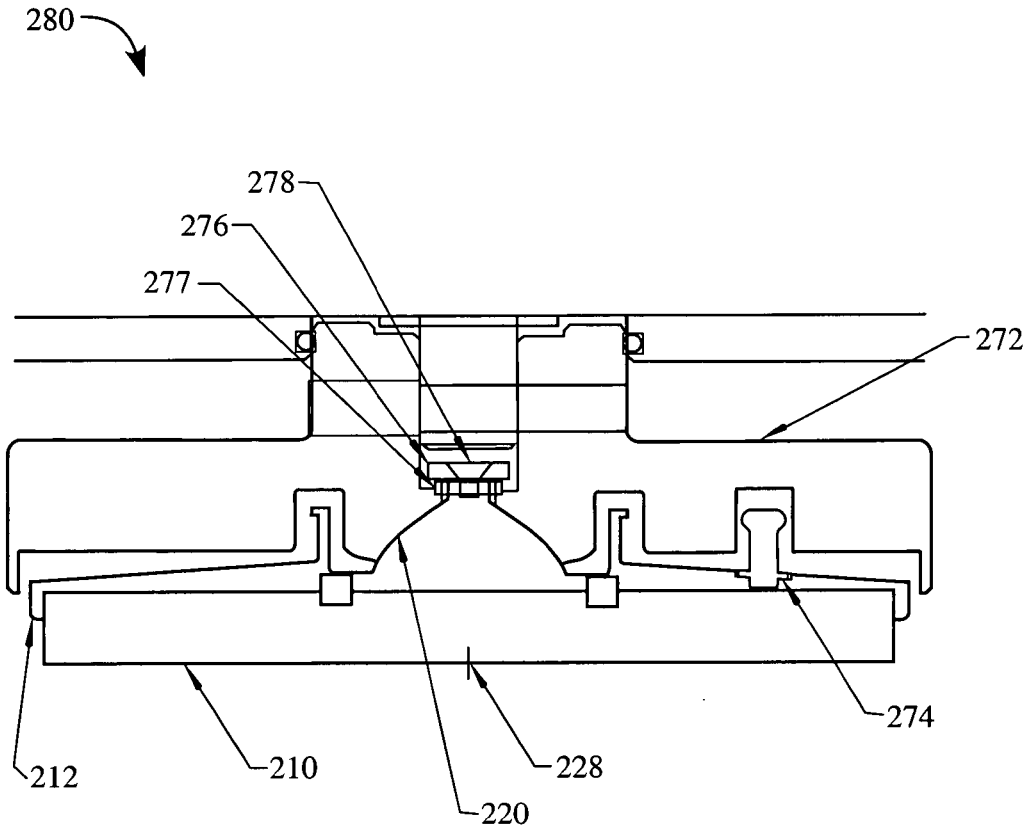
FIG. 8B illustrates pad conditioner assembly in accordance with another embodiment of the present invention.

FIG. 8B illustrates pad conditioner assembly 280 in accordance with another embodiment of the present invention. Pad conditioner assembly 280 is essentially similar to pad conditioner assembly 270 illustrated in FIG. 8A, and in one embodiment, is implemented in a rotary CMP processing system such as the rotary CMP processing system illustrated in FIG. 2A. Pad conditioner assembly 280 includes a conditioning puck 210 with an active surface, and an attach surface which is mounted in the single integral component that is puck holder 212. As shown in FIG. 8B, puck holder 212 therefore includes a first surface that defines a convex surface to directly mate with concave surface of bearing adapter 272 to define a gimbal surface 220, and a second surface that defines a lip around the periphery within which attach surface of conditioning puck 210 is received. The pad conditioner assembly 280 includes an essentially fixed bearing adapter 272 which is configured to rotate during processing surface conditioning. The bearing adapter 272, also known as a housing, is positioned by the conditioning puck positioning arm (see FIGS. 2A, 2B) to apply the active surface of the conditioning puck 210 against a processing surface (e.g., rotary CMP processing pad), and to sweep the conditioning puck 210 back and forth across the processing surface as described above in reference to FIGS. 2A and 2B.

A gimbal surface 220 is defined between puck holder 212 and essentially fixed bearing adapter 272. As described above in reference to FIGS. 7 and 8A, gimbal surface 220 provides for the active surface of conditioning puck 210 to adjust to variations and inconsistencies in the processing surface, and to maintain an essentially constant and even contact between the active surface of the conditioning puck 210 and the processing surface. In one embodiment, the bearing adapter 272 (or housing) includes an essentially concave surface which is configured to mate with the puck holder 212 having an essentially convex surface, defining the gimbal surface 220. The geometry of the gimbal surface 220 (e.g., the angle and curvature) determines the position of the gimbal point 228. In the illustrated pad conditioner assembly 280, the gimbal point 228 is projected at the active surface of conditioning puck 210. Gimbal point 228, in essentially the same plane as lateral forces applied to conditioning puck 210, creates no moment arm between the conditioning puck 210 and the gimbal point 228, and generates no moment of force. The active surface of conditioning puck 210 therefore maintains an essentially constant and even contact with the processing surface upon which it is used for conditioning, resulting in more effective and efficient conditioning of a processing surface, and less frequent replacement of consumable conditioning puck 210.

Additional structures identified on the pad conditioner assembly 280 include a fastener 278, spacer 276 and spring 277 for the attachment of the puck holder 212 to the bearing adapter 272 at a center location of pad conditioner assembly 280 and allowing for gimballed movement. The fastener 278, spacer 276, and spring 277 provide an essentially similar function as the snap ring 275, spacer 276, and spring 277 shown in FIG. 8A by providing for the attachment of the puck holder 212 to the bearing adapter 272 which allows for gimballed movement of puck holder 212. Fastener 278 provides a fast and manageable attachment that prevents separation of the puck holder 212 from the bearing adapter 272, provides for gimballed movement of the puck holder 212, and is easily and rapidly assembled and disassembled when implemented in a CMP processing system as desired. Also shown in FIG. 8B is torque pin 274 which translates rotational force from the bearing adapter 272 to the puck holder 212 to provide for conditioning puck 210 rotation during process surface conditioning.

Although the foregoing invention has been described in some detail for purposes of clarity of understanding, it will be apparent that certain changes and modifications may be practiced within the scope of the appended claims. Accordingly, the present embodiments are to be considered as illustrative and not restrictive, and the invention is not to be limited to the details given herein, but may be modified within the scope and equivalents of the appended claims.

What is claimed is:

1. A chemical mechanical planarization (CMP) conditioning apparatus designed to connect to a positioning arm, the positioning arm capable of applying the conditioning apparatus to a processing surface, comprising:

a bearing adapter having a first side and a second side, the first side being configured to connect to the positioning arm, and the second side having a concave gimbal surface; and a puck holder being defined by a single integral component, the puck holder having a first surface and a second surface, the first surface having a convex gimbal surface that is configured to directly mate with the concave gimbal surface of the housing and the second surface defining a peripheral lip within which is received a conditioning puck, the conditioning puck having an attach surface and an active surface, the concave gimbal surface and the convex gimbal surface defining a projected gimbal point at about a plane defined at about the active surface of the conditioning puck, wherein the bearing adapter and the puck holder are connected at a center location of the CMP conditioning apparatus.

2. The CMP conditioning apparatus of claim 1, wherein the conditioning puck is configured to be rotated while applied to the processing surface.

3. The CMP conditioning apparatus of claim 1, wherein the positioning arm is configured to sweep the conditioning apparatus across the processing surface while applying the conditioning apparatus to the processing surface.

4. The CMP conditioning apparatus of claim 1, wherein the processing surface is linear CMP processing belt.

5. The CMP conditioning apparatus of claim 1, wherein the processing surface is a rotary CMP processing pad.

6. The CMP conditioning apparatus of claim 1, further comprising a torque pin, the torque pin being attached to the puck holder and being received in a cavity of the housing, the torque pin enabling translation of rotational force from the housing to the puck holder.

7. A conditioning puck apparatus for use in chemical mechanical planarization (CMP), comprising:

a bearing adapter;

a gimballed puck holder connected to the bearing adapter, the gimballed puck holder being constructed of a single integral component defined of a magnetic stainless steel and having a first surface defining a convex surface configured to directly mate with a concave surface of the bearing adapter to define the gimbal surface, and a second surface defining a peripheral lip; and a conditioning puck magnetically attached to the gimballed puck holder and received within the peripheral lip, wherein the bearing adapter and the gimballed puck holder are connected at a center location of the conditioning puck apparatus, and further define a gimbal point projected on an active surface of the conditioning puck.

8. The conditioning puck apparatus of claim 7, further comprising a conditioning puck positioning arm configured to apply the conditioning puck apparatus with the conditioning puck mounted in the gimballed puck holder against a processing surface, the active surface of the conditioning puck contacting the processing surface.

9. The conditioning puck apparatus of claim 8, wherein the conditioning puck positioning arm is configured to sweep the conditioning puck apparatus across the processing surface while applying the conditioning puck apparatus against the processing surface.

10. The conditioning puck apparatus of claim 8, wherein the conditioning puck is configured to rotate while applied against the processing surface.

11. The conditioning puck apparatus of claim 8, wherein the active surface of the conditioning puck is defined of silicon and diamond.

12. The conditioning puck apparatus of claim 8, wherein the active surface of the conditioning puck is defined of magnetic stainless steel and diamond.

13. The conditioning puck apparatus of claim 8, wherein the processing surface is a linear CMP processing belt.

14. The conditioning puck apparatus of claim 8, wherein the processing surface is a rotary CMP processing pad.

15. The conditioning puck apparatus of claim 8, wherein the gimbal point projected on the active surface of the conditioning puck is configured to maintain an essentially flat and constant contact between the active surface of the conditioning puck and the processing surface while the conditioning puck apparatus is applied against the processing surface.

16. The conditioning puck apparatus of claim 7, further comprising a torque pin, the torque pin being attached to the bearing adapter and being received in a cavity of the gimballed puck holder, the torque pin enabling translation of rotational force from the bearing adapter to the gimballed puck holder.

17. A method of making a conditioning puck apparatus for use in chemical mechanical planarization (CMP), comprising:

forming a bearing adapter having a first end configured to attach to a positioning arm and a second end having a concave surface;

forming a puck holder having a first surface defining a peripheral lip within which to receive a conditioning puck and a second surface defining a convex surface, the puck holder being formed as a single integral component;

joining the bearing adapter and the puck holder by directly mating the concave surface of the bearing adapter with the convex surface of the puck holder, the joining being configured to define a gimballed attachment at a center location of the conditioning puck apparatus; and mounting a conditioning puck having an attach surface and an active surface in the puck holder, the attach surface of the conditioning puck being received within the peripheral lip of the puck holder, wherein the gimballed attachment defines a gimbal point at about the active surface of the conditioning puck.

18. The method of claim 17, further comprising:

forming a torque pin connected to the puck holder; and forming a cavity in the housing to receive the torque pin, wherein the torque pin attached to the puck holder is received in the cavity of housing to enable translation of rotational force from the housing to the puck holder.

19. A chemical mechanical planarization (CMP) conditioning apparatus designed to connect to a positioning arm, the positioning arm capable of applying the CMP conditioning apparatus to a processing surface, comprising:

a housing having a first side and a second side, the first side being configured to connect to the positioning arm, and the second side having a concave gimbal surface;

a puck holder defined from a magnetic material and being defined by a single integral component, the puck holder having a first surface and a second surface, the first surface having a convex gimbal surface that is configured to directly mate with the concave gimbal surface of the housing, the second surface defining a peripheral lip within which is received a conditioning puck, the conditioning puck having a magnetic backing for attaching to the magnetic material of the puck holder, the conditioning puck further having an active surface that is opposite the magnetic backing, the concave gimbal surface and the convex gimbal surface being connected at a center location of the CMP conditioning apparatus, and projecting a gimbal point at about a plane defined at about the active surface of the conditioning puck.

20. The CMP conditioning apparatus of claim 19, further comprising a torque pin, the torque pin being attached to the first surface of the puck holder and being received in a cavity of the second side of the housing, the torque pin enabling the translation of rotational force from the housing to the puck holder.

* * * * *